US008479626B1

(12) United States Patent
Winkler

(10) Patent No.: US 8,479,626 B1
(45) Date of Patent: Jul. 9, 2013

(54) STORAGE AND CUTTING APPARATUS FOR ROLLED SHEET MATERIALS

(76) Inventor: Richard G. Winkler, East Greenwich, RI (US)

( * ) Notice: Subject to any disclaimer, the term of this patent is extended or adjusted under 35 U.S.C. 154(b) by 389 days.

(21) Appl. No.: 12/776,021

(22) Filed: May 7, 2010

(51) Int. Cl.

| | |
|---|---|
| ***B26D 3/00*** | (2006.01) |
| ***B26D 5/08*** | (2006.01) |
| ***B26F 3/02*** | (2006.01) |
| ***B65D 21/02*** | (2006.01) |

(52) U.S. Cl.
USPC ..... 83/56; 83/613; 83/527; 225/31; 225/71; 220/23.2

(58) Field of Classification Search
USPC ..... 83/56, 613–614, 527; 225/30, 31, 225/55, 71, 89, 52; 220/23.2, 23.4, 480, 481
See application file for complete search history.

(56) References Cited

U.S. PATENT DOCUMENTS

| | | | | | |
|---|---|---|---|---|---|
| 2,135,238 | A | * | 11/1938 | Malik | 206/480 |
| 2,409,203 | A | * | 10/1946 | Gale | 83/459 |
| 2,754,991 | A | * | 7/1956 | Hagerty et al. | 220/481 |
| 3,142,217 | A | * | 7/1964 | Busse | 83/375 |
| 4,144,575 | A | | 3/1979 | Schwarz | |
| 4,156,382 | A | * | 5/1979 | Baker | 493/86 |
| 4,196,647 | A | | 4/1980 | Fish | |
| 4,754,674 | A | * | 7/1988 | Perlman | 83/422 |
| 4,787,284 | A | * | 11/1988 | Chen | 83/614 |
| 4,787,543 | A | | 11/1988 | Fabo et al. | |
| 5,011,059 | A | | 4/1991 | Jennings, Jr. et al. | |
| 5,148,932 | A | * | 9/1992 | Orefice | 220/23.2 |
| 5,186,376 | A | | 2/1993 | Scharf et al. | |
| 5,243,890 | A | * | 9/1993 | Ober | 83/471.2 |
| 5,398,576 | A | * | 3/1995 | Chiu | 83/614 |
| 5,431,294 | A | * | 7/1995 | Stottmann et al. | 220/23.4 |
| 5,758,559 | A | * | 6/1998 | Capitao et al. | 83/614 |
| 5,768,968 | A | | 6/1998 | Park et al. | |
| 6,223,639 | B1 | * | 5/2001 | Chen | 83/614 |
| 7,000,520 | B2 | * | 2/2006 | Nichols et al. | 83/578 |
| 7,415,915 | B2 | * | 8/2008 | Parrish et al. | 83/617 |
| 7,497,351 | B2 | * | 3/2009 | Amundson et al. | 221/96 |
| 7,603,937 | B2 | * | 10/2009 | Pavlik et al. | 83/614 |
| 2002/0117038 | A1 | * | 8/2002 | Vegliante et al. | 83/578 |
| 2003/0140760 | A1 | * | 7/2003 | Bory | 83/614 |
| 2004/0177738 | A1 | * | 9/2004 | Mori et al. | 83/563 |
| 2004/0206222 | A1 | * | 10/2004 | Chuang | 83/614 |
| 2004/0237746 | A1 | * | 12/2004 | Schultz et al. | 83/614 |
| 2005/0127083 | A1 | * | 6/2005 | Russell | 221/30 |

* cited by examiner

*Primary Examiner* — Ghassem Alie
*Assistant Examiner* — Bharat C Patel
(74) *Attorney, Agent, or Firm* — Montgomery Patent & Design; Robert C. Montgomery

(57) ABSTRACT

An apparatus to hold, store and cut extra wide rolled materials includes a long rectangular enclosure having a guided cutter and is capable of holding one (1) or more rolls of sheet materials for cutting to an exact length. During cutting, the rolled material is pulled out and placed over a cutting platform that runs along the length of the enclosure. A circular cutting blade being smoothly guided along a slot which extends along a length of the apparatus cuts the material. Additional storage compartments are provided which may be affixed to outer end portions of the apparatus to hold small associated items such as tape, thread, writing instruments, craft items, and the like.

9 Claims, 8 Drawing Sheets

STORAGE AND CUTTING APPARATUS FOR ROLLED SHEET MATERIALS

RELATED APPLICATIONS

The present invention was first described in a notarized Official Record of Invention on Jul. 7, 2009, that is on file at the offices of Montgomery Patent and Design, LLC, the entire disclosures of which are incorporated herein by reference.

FIELD OF THE INVENTION

The present invention relates generally to storage units, and in particular, to a device particularly adapted for the holding, storing, dispensing, and cutting of rolled materials such as wrapping paper and textiles.

BACKGROUND OF THE INVENTION

Wrapping paper is one of the most important parts of traditional gift exchanges which include birthdays, holidays, and many other occasions. However, while giving a gift is usually an enjoyable experience for both the giver and the recipient, the process of wrapping the gift is usually not. One (1) must usually pay a substantial fee to have it professionally wrapped at the store or wrap it themselves at home. The home wrapping experience usually begins by hunting down all the necessary items such as the paper, the ribbons, the bows, the gift card and other tools such as the cellophane tape, a marking pen and a pair of scissors. The rolled paper is often wrinkled from improper storage where other items have crushed it. Additionally, the process of cutting the paper is usually done freehand and results in wasted paper, irregular corners and ragged edges. The resultant wrapped gift, while done with good intentions, looks less than professional. These same problems also exist when storing and cutting other rolled materials such as textiles as well.

Various attempts have been made to provide storage devices for rolled materials. Examples of these attempts can be seen by reference to several U.S. patents. U.S. Pat. No. 4,144,575, issued in the name of Schwarz, describes a fabric dispensing apparatus with a drive belt for automatically unwinding and folding a length of rolled fabric or the like.

U.S. Pat. No. 5,186,376, issued in the name of Scharf et al., describes a plastic wrap dispenser. The Scharf device comprises a housing which is capable of mounting to a horizontal or vertical surface and includes an integral cutting edge.

While these devices fulfill their respective, particular objectives, each of these references suffer from one (1) or more of the aforementioned disadvantages. Many such devices are not adapted for storage of multiple rolls or various types of rolls. Also, many such devices are not suited for accommodating various auxiliary items which are generally desirable for use in conjunction with wrapping paper and the like. Accordingly, there exists a need for a storage means for rolled sheet materials without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a device which provides a storage and cutting means for rolled sheet materials as well as storage and other functions which are generally desirable for use in conjunction with conventional wrapping paper and the like. Thus, the object of the present invention is to solve the aforementioned disadvantages and provide for this need.

To achieve the above objectives, it is an object of the present invention to provide a means to hold, storage, and cut rolled sheet materials such as wrapping paper, textiles, and similar materials. The apparatus comprises a long rectangular enclosure, a cutting platform, a circular cutting blade, and a plurality of removably attachable storage compartments.

Another object of the present invention is to provide a storage means to various material and supplies useful for wrapping gifts and the like via the storage compartments.

Yet still another object of the present invention is to provide storage to one (1) or more rolls of sheet material in an interior compartment of the rectangular enclosure. The enclosure further comprises a lid for protection and storage purposes.

Yet still another object of the present invention is to provide storage to a variety of materials and supplies such as measuring tape, adhesive tape, scissors, and the like via a tape compartment and accessory compartment which comprise internal cavities adapted for the receiving of such items. Each compartment further comprises a lid for protection and storage purposes.

Yet still another object of the present invention is to allow a user to remove or affix the various compartments in a desired configuration to form a continuous aesthetic profile such that the compartments may be utilized individually or in any combination.

Yet still another object of the present invention is to enable quick and easy removal and attachment of the various compartments via integral corresponding male and female locking features located on side portions of each compartment. In a preferred embodiment, the locking features comprise conventional keyhole-type fasteners.

Yet still another object of the present invention is to allow a user to dispense and cut a desired length of rolled sheet material from the roll compartment by pulling a desired length of material across an edge of the rectangular roll compartment and motioning the cutter assembly laterally across the cutting platform.

Yet still another object of the present invention is to enable smooth entrapped motioning of the cutter assembly via a roll compartment cutter slot which runs along a top edge of the rectangular roll compartment. The slot comprises a mold cavity with a cross-shaped cross section which engages a corresponding portion of the cutter body.

Yet still another object of the present invention is to provide a means to position and dispense one or more spooled materials such as measuring tape, adhesive tape, ribbon stock, or the like. The tape compartment provides rotatable supported positioning of a spooled material via a plastic cylindrical adapter inserted into molded slots portions of the tape compartment.

Yet still another object of the present invention is to provide a means to cut a spooled material via a metal serrated cutter located along an edge of a tape compartment cutting platform.

Yet still another object of the present invention is to provide a method of utilizing the device that provides a unique means of selectively connecting the various compartments of the apparatus or utilizing them in an individual standalone fashion, selectively storing one (1) or more rolls of sheet material in the rectangular roll compartment, selectively storing a plurality of accessory items in the accessory compartment, selectively storing a spooled material on the adapter of the tape compartment, easily removing and cutting a desired length of sheet material via the cutter assembly of the roll compartment, easily cutting a desired length of spooled material via the adapter and serrated cutter of the tape compartment, and protecting and storing all of the said materials via closing the lids of the various compartments.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
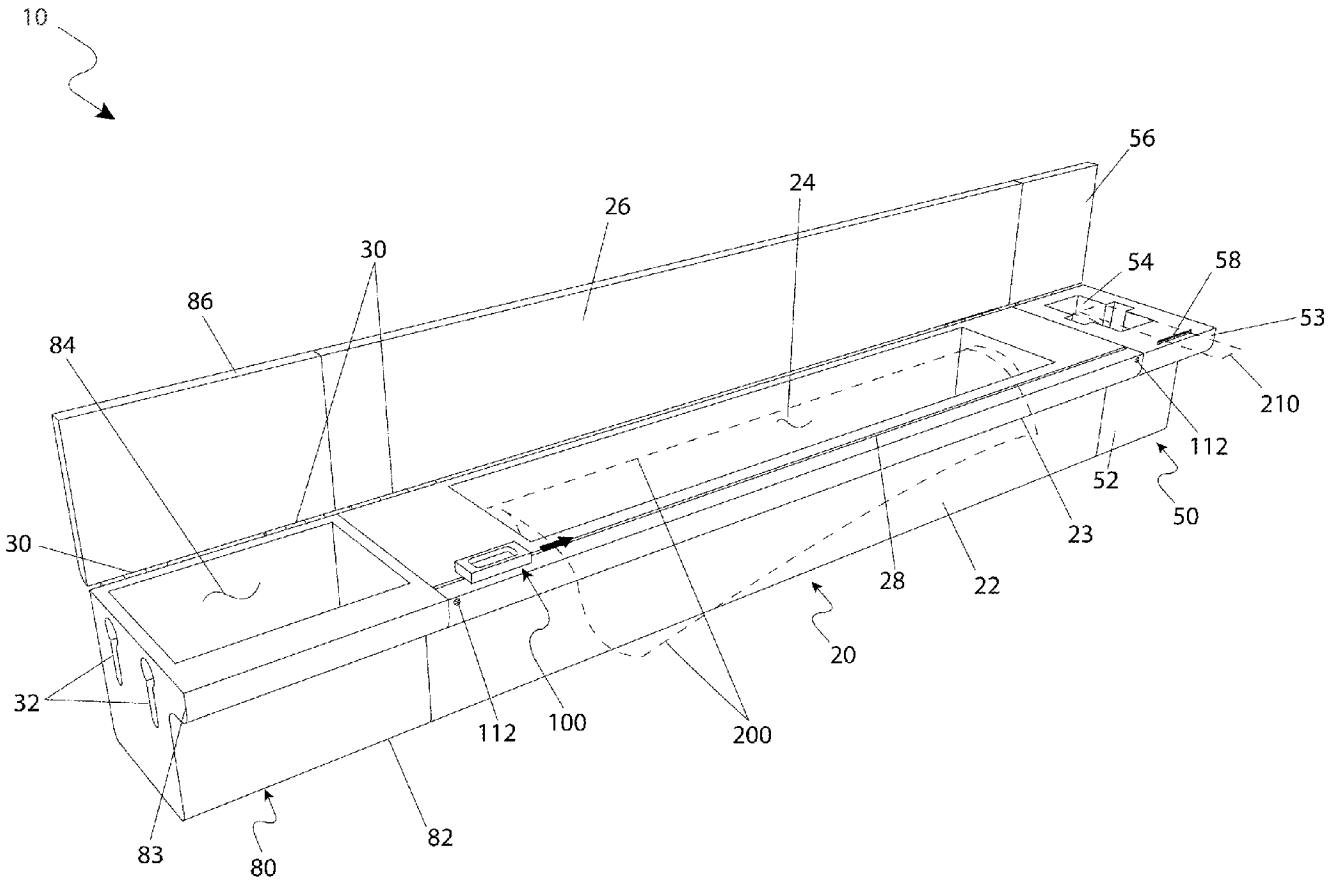
FIG. 1 is a front perspective view of a storage and cutting apparatus for rolled sheet materials 10 depicting an open state, according to a preferred embodiment of the present invention.

10 storage and cutting apparatus for rolled sheet materials
20 roll compartment assembly
22 roll compartment body
23 roll compartment cutting platform
24 roll compartment
26 roll compartment lid
28 roll compartment cutter slot
30 hinge
32 female locking feature
34 male locking feature
50 tape compartment assembly
52 tape compartment body
53 tape compartment cutting platform
54 tape compartment
55 slot
56 tape compartment lid
58 serrated cutter
66 adapter
68 adapter axle
80 accessory compartment assembly
82 accessory compartment body
83 accessory compartment platform
84 accessory compartment
86 accessory compartment lid
100 cutter assembly
102 cutter body
103 cutter body slot
104 cutter blade
106 cutter guide
107 cutter guide slot
108 cutter blade fastener
110 finger relief
112 stop fastener
200 rolled sheet material
210 spooled material

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a storage and cutting apparatus for rolled sheet materials (herein described as the "apparatus") 10, which provides a means to hold, store, and cut extra-wide rolled sheet materials 200 such as wrapping paper, textiles, and similar materials. The apparatus 10 comprises a long rectangular enclosure made preferably using injection-molded plastic and being introduced in various decorative colors and patterns; however, the apparatus 10 may also be made of wood or metal materials with equal benefit, and as such should not be interpreted as a limiting factor of the apparatus 10. When opened, the apparatus 10 comprises a roll compartment assembly 20 having a compartment 24 approximately fifty (50) inches long, thereby being capable of holding at least one (1) extra-wide portion of rolled sheet material 200 such as rolled wrapping paper, bolts of fabric, or the like. In addition to storing the rolled sheet material 200 and protecting it from damage, the apparatus 10 can also be used to cut the rolled sheet material 200 to an exact length. During cutting, the rolled sheet material 200 is dispensed over a cutting platform 23 that runs along an entire front edge of the roll compartment assembly 20. A circular cutting blade 104 contained within a cutter assembly 100 is motioned longitudinally across said cutting platform 23 to cleanly cut the rolled sheet material 200. Additionally, storage compartments are provided which may be affixed to outer ends of the roll compartment assembly 20 for holding associated materials and supplies.

Figure 2:
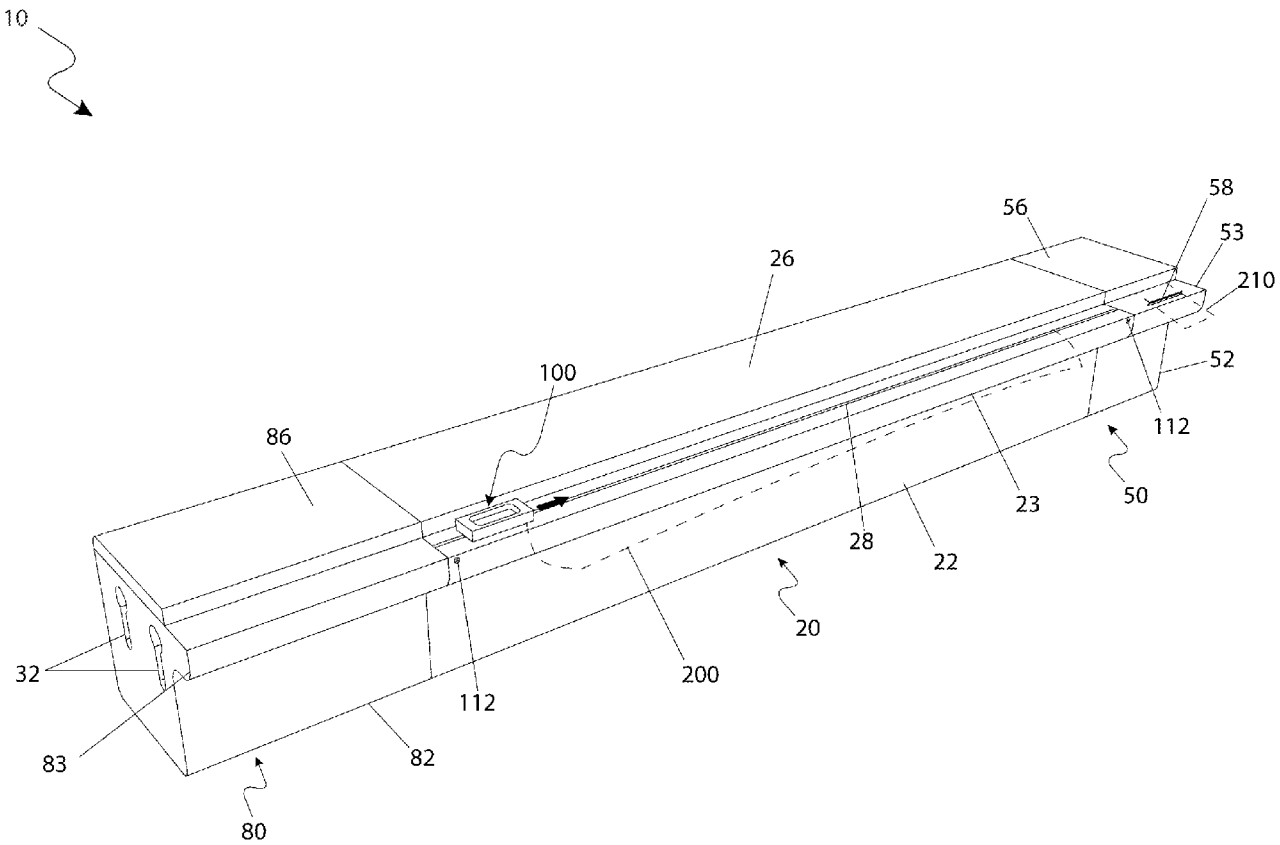
FIG. 2 is a front perspective view of the storage and cutting apparatus for rolled sheet materials 10 depicting a closed state, according to a preferred embodiment of the present invention.

Referring now to FIGS. 1 and 2, front perspective views of the apparatus 10 depicting open and closed states, according to the preferred embodiment of the present invention, are disclosed. The apparatus 10 comprises a centrally-located roll compartment assembly 20 which further provides an attachment means thereto a tape compartment assembly 50 and an accessory compartment assembly 80 thereat opposing end portions of said roll compartment assembly 20. Furthermore, said compartment assemblies 20, 50, 80 may be affixed therein various arrangements being removably affixed thereto each other to form a continuous aesthetic profile having a forwardly extending top surface forming a roll compartment cutting platform 23, a tape compartment cutting platform 53, and an accessory compartment platform 83, respectively. Finally, said compartment assemblies 20, 50, 80 may be utilized individually or in any combination with each other, as desired.

Said compartment assemblies 20, 50, 80 further comprise an internal rectangular roll compartment 24, a tape compartment 54, and an accessory compartment 84, respectively. The tape 50 and accessory 80 compartments comprise open-top cavities providing a storage means to various materials and supplies such as a measuring tape, adhesive tape, ribbon, thread, writing instruments, scissors, craft items, and the like, necessary to complete various projects such as gift wrapping, textile creations, crafting projects, and the like.

The compartment assemblies 20, 50, 80 further comprise a roll compartment lid 26, a tape compartment lid 56, and an accessory compartment lid 86, respectively, being pivotingly attached along upper rear edge portions of said respective compartment assemblies 20, 50, 80 via a plurality of common metal axial hinges 30 arranged along a common axis. When closed, the lids 26, 56, 86 cover the cavity portions of the compartments 24, 54, 84 while allowing the aforementioned platforms 23, 53, 83 to protrude outwardly therefrom. The roll compartment cutting platform 23 allows a user to dispense a length of rolled sheet material 200 outwardly from beneath the roll compartment lid 26 and cut said rolled sheet material 200 to length by motioning the cutter assembly 100 laterally across said roll compartment cutting platform 23 (see FIGS. 5*a* and 5*b*).

Figure 3:
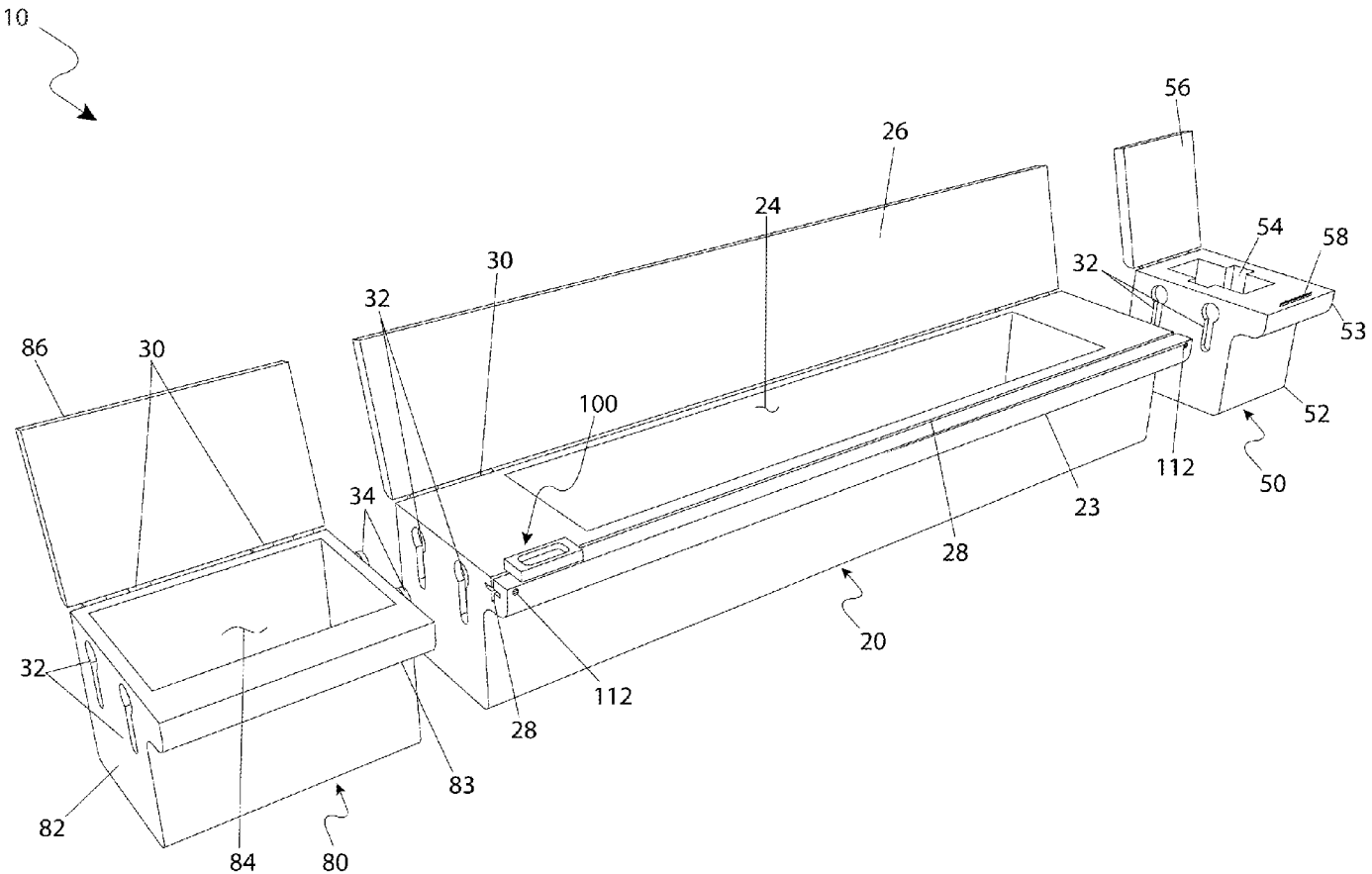
FIG. 3 is an exploded view of the storage and cutting apparatus for rolled sheet materials 10, according to a preferred embodiment of the present invention.

Referring now to FIG. 3, an exploded view of the apparatus 10, according to a preferred embodiment of the present invention, is disclosed. The apparatus 10 provides a removable detachment means between said tape 50, accessory 80, and roll 20 compartment assemblies, thereby providing various configurations of the apparatus 10 to be utilized. A user may detach any of the compartment assemblies 20, 50, 80 therefrom each other via interlocking integral female locking features 32 and male locking features 34 (see FIGS. 4A and 4B). Separation of said compartment assemblies 20, 50, 80 enables separate and/or remote use thereof. For example, said tape 50 and accessory 80 compartment assemblies may also be attached securely thereto each other using said locking features 32, 34, thereby forming a combined storage unit for craft supplies.

Figure 4A:
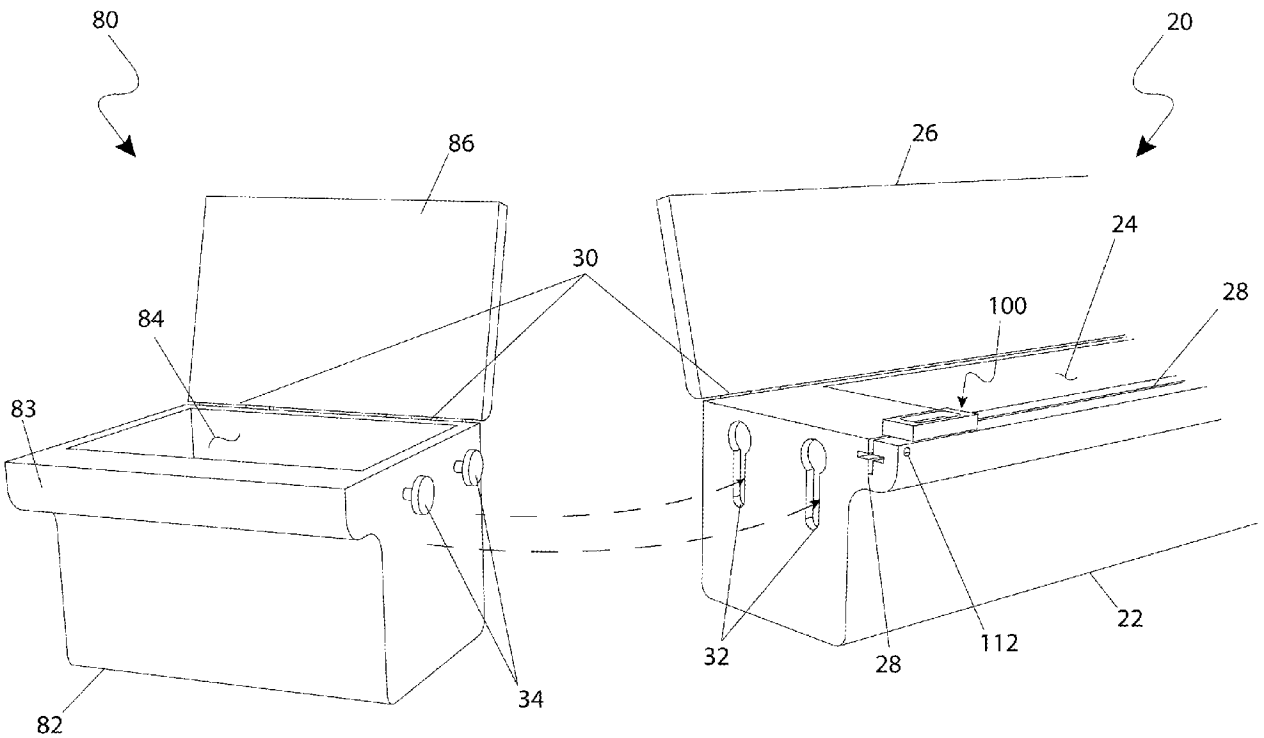
FIG. 4*a* is another exploded view of the storage and cutting apparatus for rolled sheet materials 10 depicting a joining means of a roll compartment assembly portion 20 and an accessory compartment assembly portion 80, according to a preferred embodiment of the present invention.
Figure 4B:
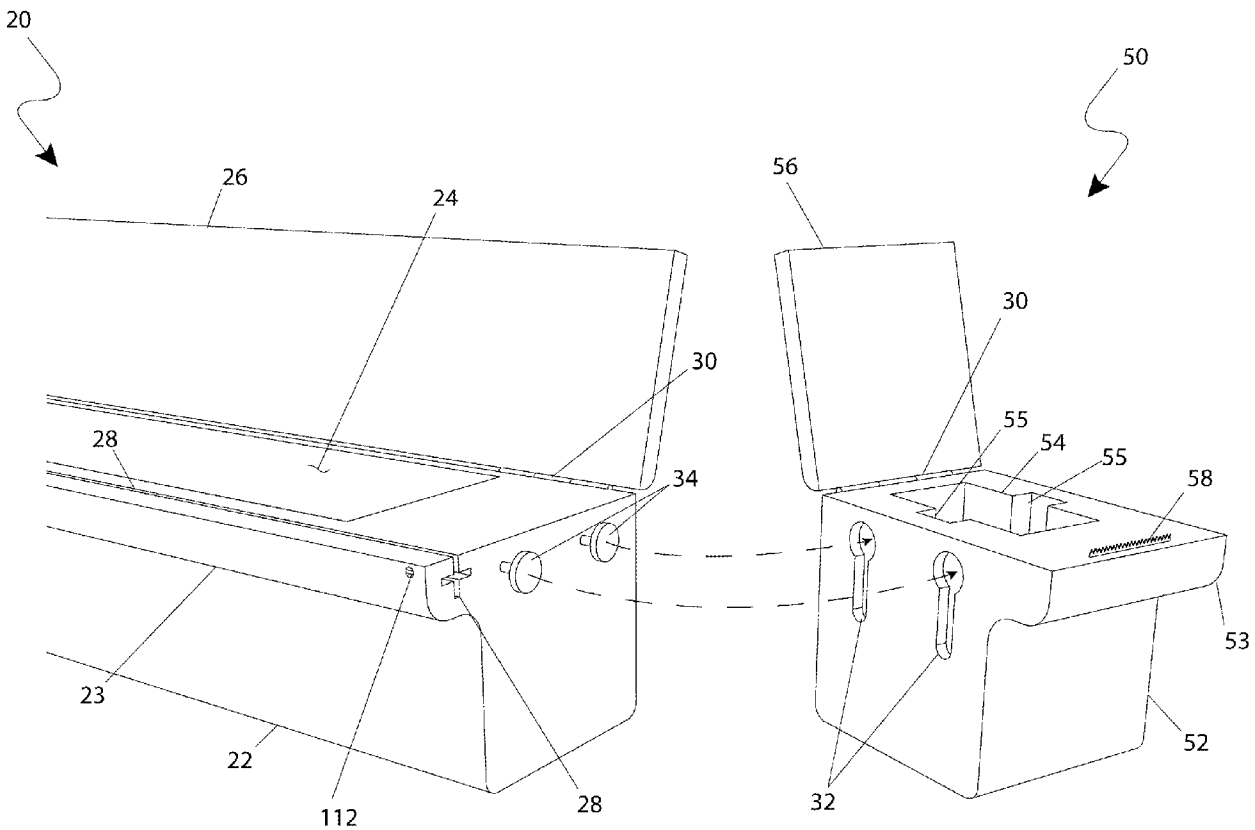
FIG. 4*b* is yet another exploded view of the storage and cutting apparatus for rolled sheet materials 10 depicting a joining means of the roll compartment assembly 20 and a tape compartment assembly portion 50, according to a preferred embodiment of the present invention.

Referring now to FIGS. 4*a* and 4*b*, exploded views of the apparatus 10 depicting a joining means thereof tape 50 and accessory 80 compartment assemblies thereto the roll compartment assembly 20, according to a preferred embodiment of the present invention, are disclosed. Adjacent compartment assemblies 20, 50, 80 are illustrated here being joined using said interlocking female 32 and male 34 locking features. The female 32 and male 34 locking features comprise integrally molded keyhole-type fastening features which provide a snug interlocking fit into each other being inserted in a horizontal direction, then motioned downwardly to form a locking connection. Complete engagement of the locking features 32, 34 provides secure positioning of said adjacent compartment assemblies 20, 50, 80 in alignment with each other resulting in a continuous profile of the apparatus 10 along a longitudinal axis. Although the female 32 and male 34 locking features are illustrated here comprising integrally molded keyhole-type fastening features, it is understood that said locking features 32, 34 are not limited to the illustrated embodiment, and a person skilled in the art will appreciate that many other attachment techniques and designs are possible such as inserted snapping posts and sockets, linear tongue and groove features, rotational bayonet-type features, and the like, without deviating from the basic concept and as such should not be interpreted as a limiting factor of the apparatus 10.

The roll 20 and tape 50 compartment assemblies further comprise a roll compartment cutter slot 28 and a serrated cutter 58, respectively. The roll compartment cutter slot 28 comprises a molded cavity having a "cross"-shaped cross section and extending downwardly from a top surface of the platform 23, thereby enabling smooth entrapped motioning of the correspondingly shaped and inserted cutter assembly 100 therealong (see FIGS. 2 and 5*a*).

Figure 5A:
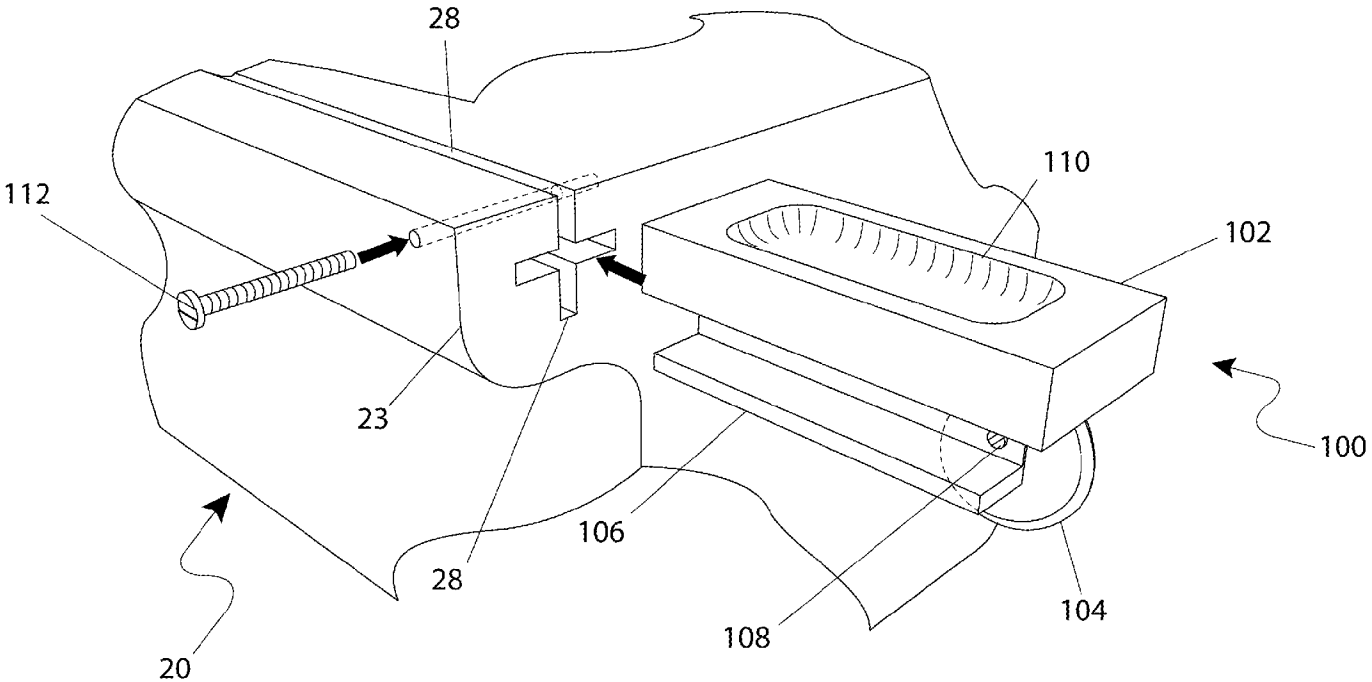
FIG. 5*a* is a top perspective view of a cutter assembly portion 100 of the storage and cutting apparatus for rolled sheet materials 10, according to a preferred embodiment of the present invention.
Figure 5B:
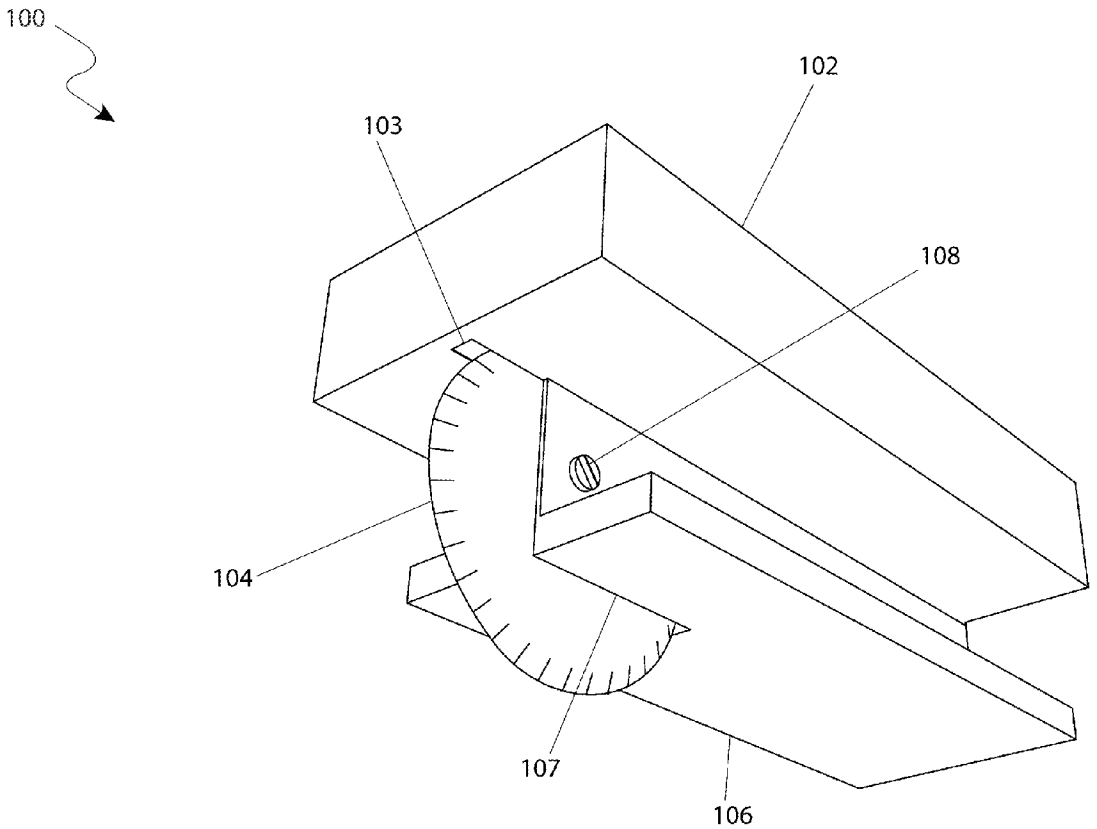
FIG. 5*b* is a bottom perspective view of a cutter assembly portion 100 of the storage and cutting apparatus for rolled sheet materials 10, according to a preferred embodiment of the present invention; and, FIG. 6 is an exploded view of the tape compartment portion 50 of the storage and cutting apparatus for rolled sheet materials 10, according to a preferred embodiment of the present invention.

Referring now to FIGS. 5*a* and 5*b*, top and bottom perspective views of a cutter assembly portion 100 of the apparatus 10, according to a preferred embodiment of the present invention, are disclosed. The cutter assembly 100 comprises a cutter body 102, a cutter body slot 103, a cutter blade 104, a cutter guide 106, a cutter guide slot 107, and a cutter blade fastener 108.

The cutter assembly 100 is entrapped and guided within the aforementioned cutter slot 28 being motioned along the roll compartment cutting platform 23 to provide smooth linear cutting of the rolled sheet material 200. Furthermore, said roll compartment cutting platform 23 provides a mechanical stop thereto said motioning via a pair of stop fasteners 112 located thereat end portions. Said stop fasteners 112 comprise removable setscrew-like threaded fasteners which extend horizontally through said roll compartment cutting platform 23 and the cutter slot 28, thereby providing a stopping means thereto lateral travel of the cutter assembly 100. Removal of one (1) or both stop fasteners 112 allows the cutter assembly 100 to be easily removed for repair or replacement.

The cutter body 102 provides a means for a user to motion the cutter assembly 100 across the compartment cutting platform 23. Said cutter body 102 comprises a rectangular shape and is envisioned being made of similar materials as the aforementioned compartment assemblies 20, 50, 80. The cutter body 102 also comprises a recessed finger relief area 110 along a top surface and an integrally-molded cutter guide 106 along a lower surface which protrudes downwardly therefrom. The cutter guide portion 106 of the cutter assembly 100 comprises a molded and inverted "T"-shaped feature particularly sized to smoothly slide within the "cross"-shaped compartment cutter slot portion 28 of the roll compartment assembly 20. The cutter body 102 and cutter guide 106 comprise a centrally-located cutter body slot 103 and cutter guide slot 107, respectively, providing attachment and clearance thereto the included cutter blade 104. The cutter guide 106 provides an attachment means thereto said cutter blade 104 being held within the cutter body slot feature 103 via a cutter blade fastener 108. The cutter blade fastener 108 comprises a common fastener such as a shoulder bolt, which acts as an axle-like member passing through a center portion of the cutter blade 104, thereby resulting in a rotating cutting motion. It is understood that the entire cutter assembly 100 may be replaced or the cutter blade 104 may be replaced when dull via removal of the cutter assembly 100, as previously described, and the cutter blade fastener 108. The cutter blade 104 is illustrated here comprising a disc-shaped member having a straight sharpened perimeter edge; however it is envisioned that the cutter blade 104 may be replaced with cutter blades 104 having various shaped edge portions, thereby producing corresponding cut edge portions thereupon the rolled sheet material 200 such as zig-zag, serpentine, and the like.

Figure 6:
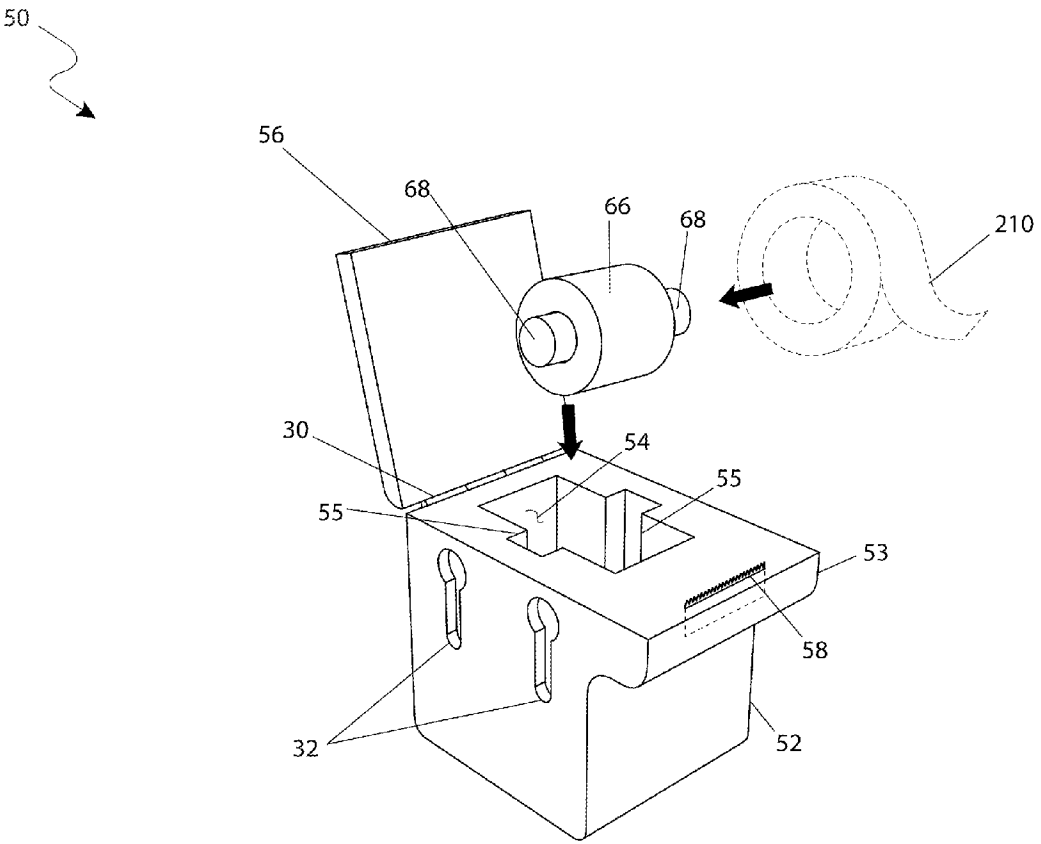

Referring now to FIG. 6, an exploded view of the tape compartment assembly portion 50 of the apparatus 10, according to a preferred embodiment of the present invention, is disclosed. The tape compartment assembly 50 provides a means to position and dispense one (1) or more spooled materials 210 such as, but not limited to: a measuring tape, adhesive tape, ribbon stock, and thread, which are utilized during use of the apparatus 10. The tape compartment assembly 50 further comprises a tape compartment 54, a pair of vertical slots 55, a serrated cutter 58, an adapter 66, and a pair of adapter axles 68. The tape compartment 54 provides supported positioning of a spooled material 210 such as tape, ribbon, or the like. Said spooled material 210 is rotationally positioned via the adapter 66 being inserted into a center opening portion of the spooled material 210. The adapter 66 comprises a plastic cylindrical shape having integral opposing extending adapter axles 68 being inserted into molded-in vertical slot portions 55 of the tape compartment 54 in a similar manner as a traditional adhesive tape dispenser. It is envisioned that the adapter 66 may be provided having various outer diameters being suitable of various spooled materials 210 having different inner opening diameters, thereby stabilizing said spooled materials 210 therewithin the tape compartment 54.

The tape compartment assembly 50 provides a means to cut said spooled materials 210 via a serrated cutter 58 being embedded thereinto and extending upwardly and across the tape compartment cutting platform 53. Said serrated cutter 58 comprises a common metal serrated blade being similar to those used on common tape dispensers.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 through 6.

The method of assembling and utilizing the apparatus 10 may be achieved by performing the following steps: assembling the compartment assemblies 20, 50, 80 together to form a single unit or; utilizing said compartment assemblies 20, 50, 80 in pairs or individual units as desired by; engaging the respective female 32 and male 34 locking features therein a horizontal direction, then motioning said features 32, 34 vertically to interlock; lifting the lid portions 26, 56, 86 of the apparatus 10 thereto an open state; loading one (1) or more desired rolled sheet materials 200 such as wrapping paper, fabric bolts, or similarly embodied materials into the roll compartment 24; loading miscellaneous supplies such as writing instruments, scissors, craft items, and the like, necessary to complete various projects, into the accessory compartment 84, and if so desired, into the tape compartment assembly 50; extending a loose end portion of said rolled sheet material 200 over the roll compartment cutting platform 23; closing the lid portion 26 of the roll compartment assembly 20; dispensing a desired length of rolled sheet material 200 by grasping and pulling said rolled sheet material 200 outwardly from the apparatus 10; pressing down on the roll compartment lid 26 to secure the rolled sheet material 200 in position; cutting said rolled sheet material 200 by sliding the cutter assembly 100 along the roll compartment cutting platform 23 to sever the dispensed portion of the rolled sheet material 200; repeating the dispensing and cutting procedure to the rolled sheet material 200 as needed to complete a project; utilizing the supplies therein the tape 54 and accessory 84 compartments as needed; and, producing accurately cut portions of rolled sheet material 200 wound thereon extra-wide rolls to complete gift wrapping, textile creations, crafting projects, and the like, using the present invention 100.

The tape compartment assembly 50 may be utilized to dispense one (1) or more spooled materials 210 such as a measuring tape, adhesive tape, ribbon, and/or thread, by performing the following additional steps: joining the tape compartment assembly 20 thereto the other compartment assemblies 50, 80 or separating the tape compartment assembly 50 from said compartments 50, 80 by connecting or disconnecting respective female 32 and male 34 locking features; opening the tape compartment lid 56; removing the adapter 66 from the tape compartment 54; inserting said adapter 66 into a center opening of the spooled material 210; inserting the adapter 66 and spooled material 210 into the tape compartment 54 by engaging the adapter axle portions 68 into the slot portions 55 of the tape compartment 54; manually grasping and extending a loose end portion of said spooled material 210 forwardly across the serrated cutter 58 on the tape compartment cutting platform 53; cutting a desired length of spooled material 210 in a conventional manner as needed.

The entire cutter assembly 100 may be replaced by performing these steps: removing one (1) or more of the stop fasteners 112; sliding said cutter assembly 100 from the roll compartment cutter slot portion 28 of the roll compartment assembly 20; installing a new cutter assembly 100; reinserting the new cutter assembly 100 into the roll compartment cutter slot 28; and, reinstalling the stop fasteners 112. Furthermore, the cutter blade portion 104 of the cutter assembly 100 may be replaced when dulled by removing the cutter assembly 100 as described; removing the cutter blade fastener 108; removing the worn cutter blade 104; installing a new cutter blade 104; replacing the blade fastener 108; and, reinserting the cutter assembly 100 as described above (see FIG. 5A).

The compartment assembly portions 20, 50, 80 of the apparatus 10 may be reconfigured as desired using the female 32 and male 34 locking features to detach either or both of the tape compartment assembly 50 and accessory compartment assembly 80 from the roll compartment assembly 20. Furthermore, the tape 50 and accessory 80 compartment assemblies may be detached from the roll compartment assembly 20 and attached thereto each other if desired, to form a combined supplies storage unit. Finally, additional tape 50 and accessory 80 compartment assemblies may be purchased and joined together in like manner using said female 32 and male 34 locking features to expand capabilities of the apparatus 10 as desired to complete various projects.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A storage and cutting apparatus for a rolled sheet material, further comprising:

an elongated enclosure, comprising a lid hingedly attached at a rear edge thereof and a roll compartment centrally located within said enclosure, accessible by said lid; wherein said roll compartment comprises approximately fifty (50) inches in length, thereby being capable of holding at least one extra-wide portion of said rolled sheet material;

a cutting assembly operably disposed along a front edge of said roll compartment, comprising:

a cutter body, comprising a rectangular body with a recessed finger relief area disposed along an upper surface thereof;

a cutter body slot centrally located within said cutter body at a first end;

a cutter blade, comprising a cutting wheel with a sharpened edge attached within said cutter body slot such that a portion of said cutter blade is exposed;

a cutter guide comprising an integral portion of a lower surface of said cutter body and protruding downwardly therefrom, further comprising a "T"-shaped feature;

a cutter blade fastener for removably fastening said cutter blade to said cutter body; and, a pair of stop fasteners removably placed at either distal ends of said cutter slot;

a cutting platform coextensive with said front edge and extending outwardly therefrom;

wherein said rolled sheet material is removably disposed within said roll compartment assembly;

wherein said cutting assembly cuts a desired amount of said rolled sheet material;

wherein said cutter guide is correspondingly inserted and guided within said cutter body slot being motioned along said cutting platform to provide a smooth and linear cut of said desired amount of said rolled sheet material;

wherein said pair of stop fasteners provides a mechanical stop for said cutting assembly;

wherein said cutting assembly is motioned across said cutting platform during cutting of said rolled sheet material; and, wherein said lid does not interfere with said cutting assembly.

2. The apparatus of claim 1, wherein said enclosure further comprises a roll compartment cutter slot having a "cross"-shaped cross-section and extending downwardly from a top surface and longitudinally extending coextensive with said cutting platform, thereby enabling smooth entrapped motioning of said cutter assembly.

3. A storage and cutting apparatus for a rolled sheet material, further comprising:

an elongated enclosure, comprising a lid hingedly attached at a rear edge thereof and a roll compartment centrally located within said enclosure, accessible by said lid; wherein said enclosure further comprises a roll compartment cutter slot having a "cross"-shaped cross-section and extending downwardly from top surface and longitudinally extending coextensive with said cutting platform, thereby enabling smooth motioning of said cutter assembly;

a cutting assembly operably disposed along a front edge of said roll compartment, comprising:

a cutter body, comprising a rectangular body with a recessed finger relief area disposed along an upper surface thereof;

a cutter body slot centrally located within said cutter body at a first end;

a cutter blade, comprising a cutting wheel with a sharpened edge attached within said cutter body slot such that a portion of said cutter blade is exposed;

a cutter guide comprising an integral portion of a lower surface of said cutter body and protruding downwardly therefrom, further comprising a "T"-shaped feature; and, a cutter blade fastener for removably fastening said cutter blade to said cutter body;

a cutting platform coextensive with said front edge and extending outwardly therefrom; and, at least one auxiliary compartment assembly removably fastened to an end wall of said elongated enclosure;

wherein said rolled sheet material is removably disposed within said roll compartment assembly;

wherein said cutting assembly cuts a desired amount of said rolled sheet material;

wherein said cutter guide is correspondingly inserted and guided within said cutter body slot being motioned along said cutting platform to provide a smooth and linear cut of said desired amount of said rolled sheet material;

wherein said cutting assembly is motioned across said cutting platform during cutting of said rolled sheet material;

wherein said lid does not interfere with said cutting assembly; and, wherein said at least one auxiliary compartment assembly provides a mechanical stop for said cutting assembly.

4. The apparatus of claim 3, wherein said roll compartment comprises approximately fifty (50) inches in length, thereby being capable of holding at least one extra-wide portion of said rolled sheet material.

5. The apparatus of claim 3, wherein said auxiliary compartment assembly further comprises a tape compartment assembly further comprising:

a tape compartment enclosure, comprising a hingedly attached lid providing access thereto an interior, a receiver on a first side attachable to a corresponding fastener on said end wall of said enclosure, and a tape cutting platform coextensive with a front edge of said tape compartment enclosure and extending outwardly therefrom;

a spool of tape removably disposed within said tape compartment enclosure;

a pair of vertical slots along opposing side walls of said tape compartment enclosure;

an adapter rotatably positioning said spool of tape and inserted within a center aperture of said spool of tape, further comprising a cylindrical member having a pair of adapter axles opposingly extending outward therefrom for insertion into said pair of vertical slots;

a serrated cutter embedded into and extending upwardly and across said tape cutting platform;

wherein said tape cutting platform is coextensive with said cutting platform when said tape compartment assembly is attached to said enclosure;

wherein said serrated cutter cuts a desired length of tape advanced from said spool of tape.

6. The apparatus of claim 5, wherein said auxiliary compartment assembly further comprises an accessory compartment assembly, further comprising:

an accessory enclosure, comprising a hingedly attached lid providing access thereto an interior, and a fastener on a first side attachable to a corresponding receiver on said end wall of said enclosure;

wherein a front edge of said accessory compartment assembly is coextensive with said cutting platform when attached to said enclosure.

7. The apparatus of claim 5, further comprising a pair of stop fasteners removably placed at either distal ends of said cutter slot;

wherein said pair of fasteners provides a mechanical stop for said cutting assembly.

8. The apparatus of claim 3, wherein said auxiliary compartment assembly further comprises an accessory compartment assembly, further comprising:

an accessory enclosure, comprising a hingedly attached lid providing access thereto an interior, and a fastener on a first side attachable to a corresponding receiver on said end wall of said enclosure;

wherein a front edge of said accessory compartment assembly is coextensive with said cutting platform when attached to said enclosure.

9. The apparatus of claim 3, further comprising a pair of stop fasteners removably placed at either distal ends of said cutter body slot;

wherein said pair of fasteners provides a mechanical stop for said cutting assembly.

* * * * *